US005779234A

United States Patent [19]

Tomii et al.

[11] Patent Number: 5,779,234

[45] Date of Patent: Jul. 14, 1998

[54] PRINTER SHEET DISCHARGE METHOD

[75] Inventors: Tsuyoshi Tomii; Shigeki Hayashi; Takashi Akahane, all of Nagano, Japan

[73] Assignee: Seiko Epson Corporation, Tokyo-to, Japan

[21] Appl. No.: 653,163

[22] Filed: May 24, 1996

[30] Foreign Application Priority Data

May 24, 1995 [JP] Japan ..... 7-149639

[51] Int. Cl.[6] ..... B65H 5/22

[52] U.S. Cl. ..... 271/3.2; 271/119; 271/225; 271/184; 271/902

[58] Field of Search ..... 271/225, 188, 271/184, 902, 3.14, 119, 3.19, 3.2

[56] References Cited

U.S. PATENT DOCUMENTS 4,438,915 3/1984 Akamatsu et al. ..... 271/902 X 4,844,633 7/1989 Greenberg ..... 400/120

FOREIGN PATENT DOCUMENTS 0 573 272 12/1993 European Pat. Off. ..... B41J 13/00

2 705 058 11/1994 France ..... B41J 23/16

170373 7/1993 Japan ..... 271/902

6-91861 4/1994 Japan .

*Primary Examiner*—Boris Milef

*Attorney, Agent, or Firm*—Stroock & Stroock & Lavan, LLP

[57] ABSTRACT

A method for discharging a sheet from a printer that includes feeding a first sheet from a sheet tray, conveying the sheet by the force applied by the driving roller until a leading edge of the first sheet contacts the trailing edge of a second sheet, thereby urging the second sheet in the feed direction such that the second sheet is no longer supported by supporting portions, and reversing the direction of the first sheet by reversing the rotation of the driving roller.

12 Claims, 7 Drawing Sheets

PRINTER SHEET DISCHARGE METHOD

BACKGROUND OF THE INVENTION

1. Field of the Invention

The invention relates to a method for discharging a sheet from a printer. More specifically, the invention is directed to a discharge method in which a sheet having data printed on a front surface thereof is discharged with both side portions thereof supported by a pair of support members from below, and in which a leading edge of a succeeding sheet is caused to come in contact with a trailing edge of the sheet supported by the support members, so that the supporting of the trailing edge of the sheet by the support members can be released to completely discharge the sheet.

2. Related Art

Generally, ink jet printers are designed to print data on a sheet by jetting ink droplets onto the sheet. Therefore, during the process of continuous printing on a plurality of sheets, if a succeeding sheet slidably contacts the printed surface of an already-discharged sheet before the ink on the discharged sheet has dried, the printed surface of the discharged sheet may be smeared or stained.

One ink jet printer construction that has attempted to solve this problem is described in Japanese Unexamined Patent Publication 91861/1994. A perspective view of the sheet discharge portion 601 of this ink jet printer is depicted in FIGS. 4–7. Discharge portion 601 includes an ink jet head 660, and a frame 614, which includes thereon a pair of integrally formed supporting portions 612*a* and 612*b*. Supporting portions 612*a*, 612*b* respectively guide and support from below each side portion of sheet P, which has been previously printed upon on an upper surface thereof by means of a print head 660 and is being discharged therefrom. A plurality of discharging rollers 606, typically knurled, for discharging sheet P are mounted above sheet P. Below the knurled rollers 606 are rubber rollers 607, which are designed to impart a forward-feeding force to sheet P when rubber rollers 607 contact the bottom surface of sheet P. Sheet P is eventually discharged onto discharge plate 605, which may be rotatably mounted with respect to discharge frame 614.

An arm, generally indicated at 613*a*, is rotatably mounted on a frame (not shown). Arm 613*a* includes a pushing-down portion 613, rotatably supported thereon, which may be in the form of a thin, plate-shaped, star wheel. Pushing-down portion 613 exerts a downward force on the central portion of sheet P being discharged from discharge portion 601.

The sheet discharge operation of this conventional type of printer will now be described. Sheet P is printed upon in the print section and passes into discharge portion 601. At this time, each side of sheet P is guided upwardly by upper surfaces 612*a*' and 612*b*' of respective supporting portions 612*a* and 612*b*. At the same time, although the central portion of sheet P exerts an upward force on pushing-down portion 613 and rotating arm 613*a*, the central portion of the sheet gradually falls below pushing-down portion 613 and is urged downwardly due to the weight of pushing-down portion 613 and arm 613*a* against the central portion of sheet P. Thus, as sheet P is discharged, it is forcibly urged into a concave shape as viewed in the discharging direction. This type of concave shape may also be achieved without a pushing-down portion since the weight of the sheet itself may cause the concavity thereof. Nonetheless, as sheet P is forcibly urged into this concave shape, the sheet will stiffen and will move along in the discharging direction as if it were floating. Because of this, as is more particularly depicted in FIG. 5, the time until discharged sheet P slidably contacts a printed surface P1f of sheet P1 (sheet that was previously printed, discharged, and stacked on a sheet discharge tray 605) is delayed. This method of delaying the subsequent sheet from contacting the previously discharged sheet allows sufficient time for the ink to dry on printed sheet P1 before contact with sheet P takes place.

FIG. 6 illustrates sheet P after it has been further discharged from discharge portion 601, and its trailing edge Pb has passed transport section 601. At this time, sheet P loses its transporting force in the discharge direction because discharge rollers 606' cease acting on sheet P. The rear portion Pc of sheet P is maintained in its concave state, however, by the downward force of pushing-down portion 613 upon the central portion of rear portion Pc of sheet P and the upward force of support portions 612*a*, 612*b* upon the sides of sheet P.

As shown in FIG. 7, as a subsequent sheet P2 enters transport portion 601, it is urged forward by discharge rollers 606' and, as a result, its leading edge P2*a* passes transport section 601. When leading edge P2*a* contacts trailing edge Pb of the preceding sheet P, preceding sheet P is stacked on the earlier printed sheet P1 (FIG. 5). The time until sheet P2 contacts printed sheet P is delayed in the same manner sheet P was delayed, described above.

If the conventional method described above is employed—i.e., sheet P is urged forward when leading edge P2*a* of succeeding sheet P2 contacts trailing edge Pb of sheet P—leading edge P2*a* of sheet P2 may, in some cases, engage with trailing edge Pb of preceding sheet P at locations "e" (FIG. 7). When this engagement of succeeding sheet P2 and preceding sheet P occurs, sheet P is urged forward, but is not stacked correctly on sheet discharge tray 605, because succeeding sheet P2 prevents sheet P from moving freely and completely discharging onto discharge tray 605. That is, when the conventional method of discharging sheet is used, the operation of stacking sheet on sheet discharge tray 605 (or onto preceding sheet P1 (see FIG. 5)) is unreliable at times because succeeding sheet P2 becomes attached to trailing edge Pb of preceding sheet P.

To overcome this problem, the following measure is taken in the above-described ink jet printer. When the trailing edge Pb of sheet P is contacted by leading edge P2*a* of succeeding sheet P2, the engagement of leading edge P2*a* of succeeding sheet P2 with trailing edge Pb of sheet P is released by temporarily stopping the feeding of succeeding sheet P2 while sheet P continues in the sheet-feed direction impelled by the contact of succeeding paper P2. Even if the feeding of succeeding paper P2 is temporarily halted, however, the engagement of leading edge P2*a* of succeeding paper P2 often is not released by the inertia of the preceding paper P. As a result, the operation of dropping and stacking preceding paper P onto paper discharge tray 605 is unreliable.

Accordingly, a paper discharge method, which overcomes the aforementioned disadvantages and limitations, and which provides for the reliable discharge and stacking of paper from a printer, is desired.

SUMMARY OF THE INVENTION

A method for discharging a sheet from a printer having supporting portions for supporting from below a first sheet, including the steps of: feeding a second sheet through a sheet path until a leading edge of the second sheet contacts a trailing edge of the first sheet, thereby urging the first sheet in a direction to discharge the first sheet from the two supporting portions, and reversing the feed direction of said second sheet. In this manner, the first sheet may be stacked on the sheet discharge tray in a reliable manner, as there is no possibility that the first and second sheet will remain attached upon contact with each other.

In a preferred embodiment, the method for discharging a sheet from a printer involves a printer having a sheet tray, a sheet feed roller, a driving roller, and two supporting portions for supporting from below a first sheet. The method includes the steps of: feeding a second sheet from the sheet tray in the sheet-feed direction by rotating the sheet feed roller; conveying the second sheet by the force applied by the driving roller until a leading edge of the second sheet contacts a trailing edge of the first sheet, thereby urging the second sheet in the sheet-feed direction such that the second sheet is no longer supported by the two supporting portions; and reversing the direction of the second sheet by reversing the rotation direction of the driving roller.

In yet another preferred embodiment, the method involves a printer which further includes a print region. In this method, the method includes the further steps of printing upon the second sheet as it is conveyed through the print region prior to contacting the trailing edge of the first sheet; and repositioning the second sheet by reversing the rotation of the driving roller such that printing may resume at the point where the direction of the second sheet was reversed.

Accordingly, it is an object of the invention to provide a sheet discharge method for a printer in which a sheet is stacked onto the sheet discharge tray in a reliable manner.

Another object of the invention is to provide a method of discharging a sheet that allows a printed-upon sheet to dry, yet maintains a simple and reliable means of stacking that sheet.

Yet another object of the invention is to provide a method of discharging a sheet which prevents discharged sheets from sticking to a preceding sheet as they are discharged.

Still other objects and advantages of the invention will in part be obvious and will in part be apparent from the specification.

The invention accordingly comprises the several steps and the relation of one or more of such steps with respect to each of the others thereof, which will be exemplified in the method hereinafter disclosed, and the scope of the invention will be indicated in the claims.

BRIEF DESCRIPTION OF THE DRAWINGS

For a fuller understanding of the invention, reference is made to the following description taken in connection with the accompanying drawings in which.

DESCRIPTION OF THE PREFERRED EMBODIMENTS

Figure 1A:
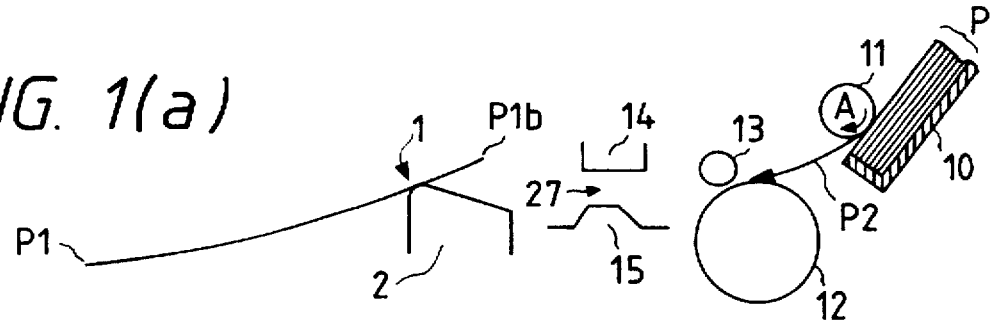
FIGS. 1*a* through 1*e* are schematic views showing the operation of a sheet discharge method for a printer in accordance with the invention.

Reference is made to FIGS. 1*a* through 1*e*, wherein a series of diagrams illustrate a sheet discharge method for a printer. The printer includes a sheet feed tray 10 which may accommodate a plurality of sheets P. A feed roller 11 is disposed within the printer to feed sheet P from feed tray 11. Sheet feed roller 11 is positioned to be in contact with the surface of the uppermost sheet in the sheet feed tray 10. A drive roller 12 is disposed downstream of feed roller 11 along a sheet feed path and is selectively in pressing engagement with a pinch roller 13 to form a nip region 25. A print region 27, wherein sheet P is printed, is downstream of feed roller 11 along the sheet feed path. Sheets P may consist of paper or any other print media. A print head 14 and a regulating member are disposed within the print region. Supporting portions 2 are disposed downstream of print region 27.

When a sheet is required for printing, sheet P2 is fed along the sheet path by sheet feed roller 11, which is caused to rotate while in contact with sheet P2. As indicated in FIG. 1A, the leading edge P2*a* of sheet P2 is guided by a guide member (not shown) to nipping region 25 of driving roller 12 and a pinch roller 13, which rotates while being in pressing contact with driving roller 12. When leading edge P2*a* of sheet P2 enters nipping region 25, sheet P2 is conveyed between driving roller 12 and pinch roller 13 by the force applied by driving roller 12. Sheet P2 is fed into print region 27, which includes print head 14 and a regulating member 15. As sheet P2 is fed by driving roller 12, regulating member 15 guides sheet P2 and regulates the distance between sheet P2 and print head 14 that prints characters and images on sheet P2 while it is being conveyed in the sheet-feed direction. After sheet P2 has been printed upon, it is fed through a set of sheet discharge rollers, mounted above and below the discharging sheet (not shown) in a manner similar to sheet discharge rollers 606 and 607 shown in FIG. 4.

Figure 4:
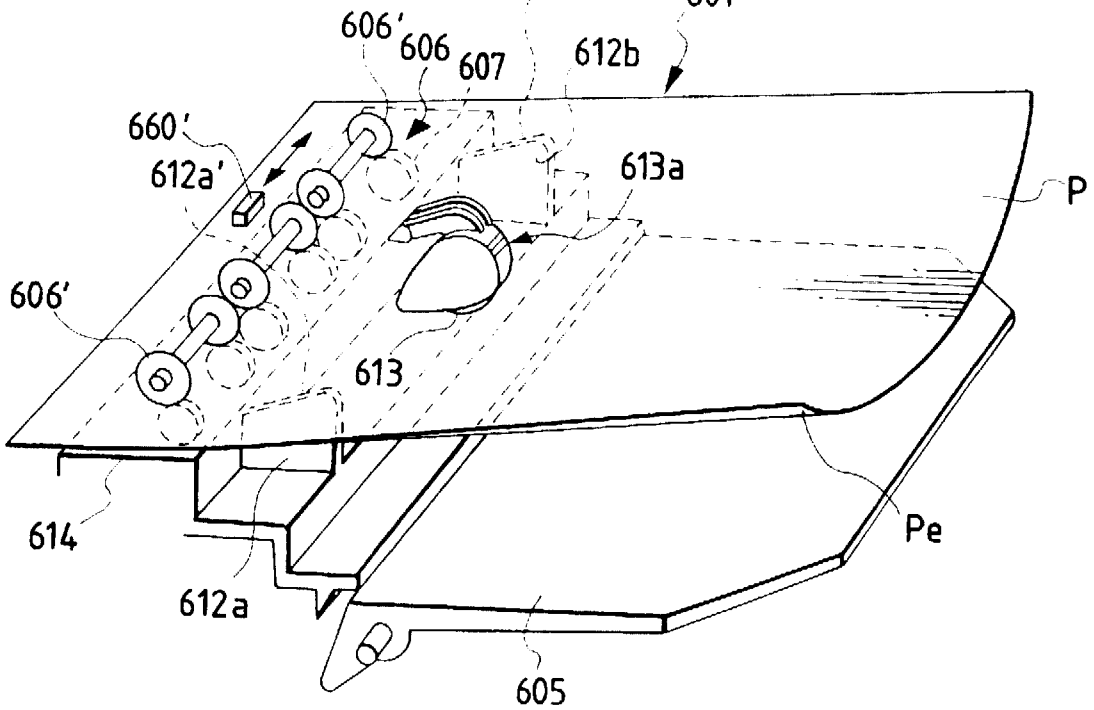
FIG. 4 PRIOR ART
FIGS. 4–7 depict printer discharge portions constructed in accordance with the prior art.
Figure 5:
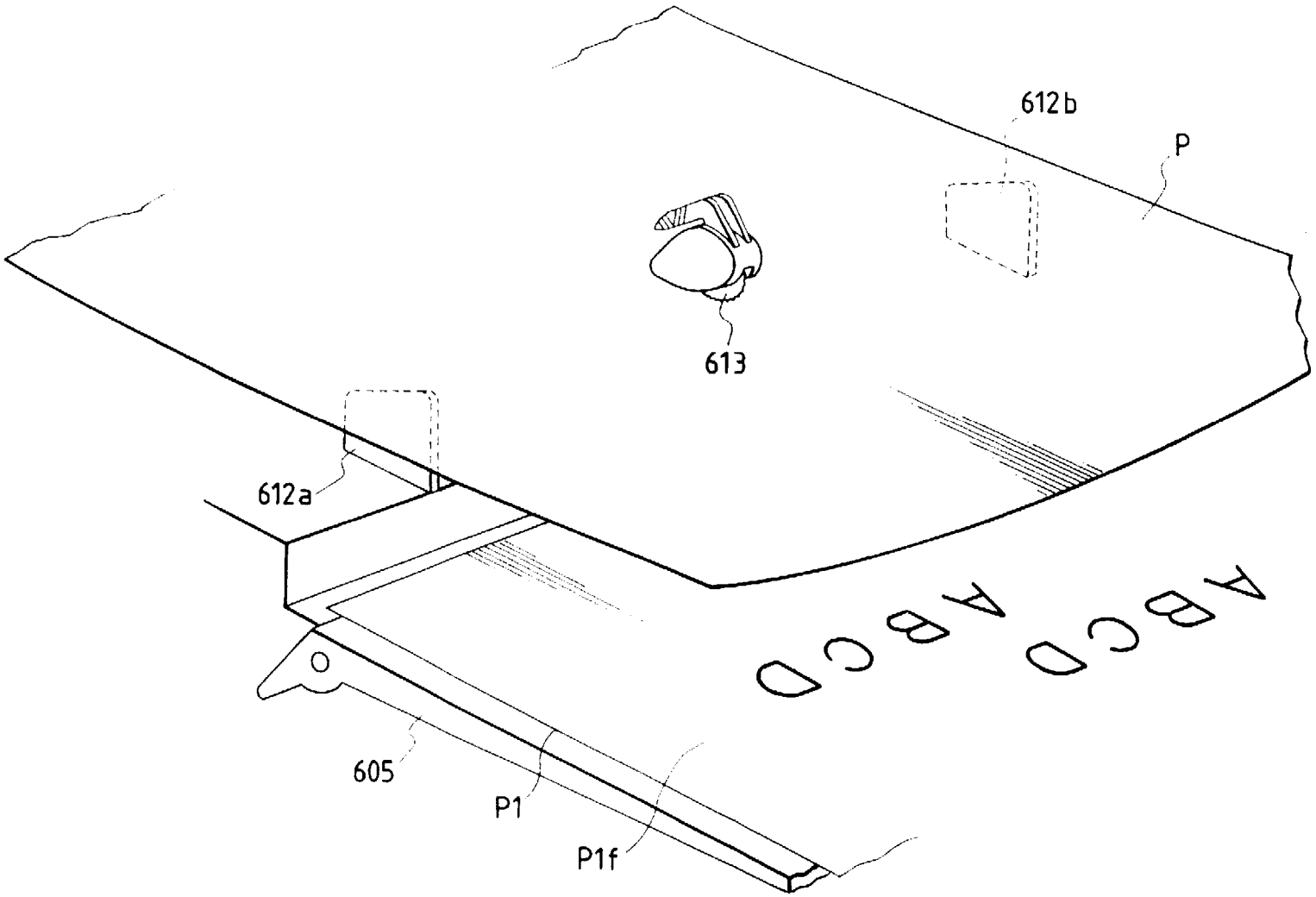
FIG. 5 PRIOR ART

A sheet discharge section 1 is constructed similarly to the sheet discharge section in the prior art depicted in FIG. 4. That is, sheet discharge section 1 includes two supporting portions 2 (one of which is shown in FIG. 1) and a pushing-down portion (not shown). Side supporting portions 2 guide and support from below both side portions of sheet P2, which has been previously printed upon an upper surface thereof by means of print head 14 and is being discharged therefrom. Supporting portions 2 may be thin, integrally formed, immovable rib-like members, having their respective upper surfaces inclined upwards in the sheet-discharging direction, but may be shaped and structured in any manner so long as the supporting portions do not interfere with the sheet discharge and guide and support of the sheet. A pushing-down portion (not shown), similar to that shown in FIG. 4, exerts a downward force on the central portion of sheet P2 being discharged from sheet discharge section 1.

Figure 1B:
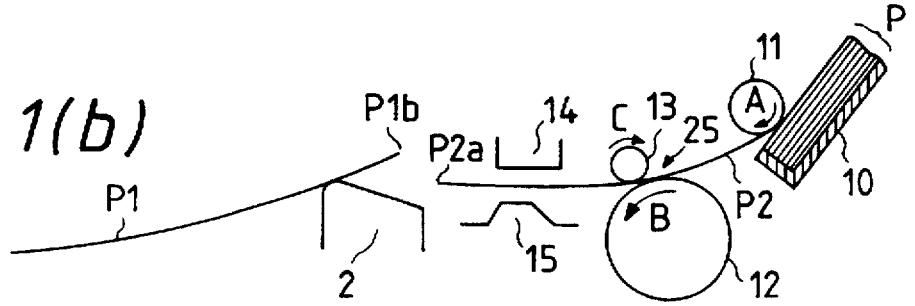
Figure 1C:
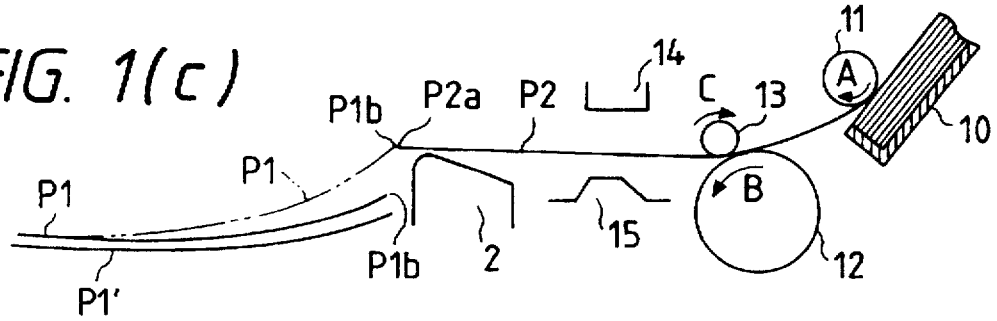
Figure 6:
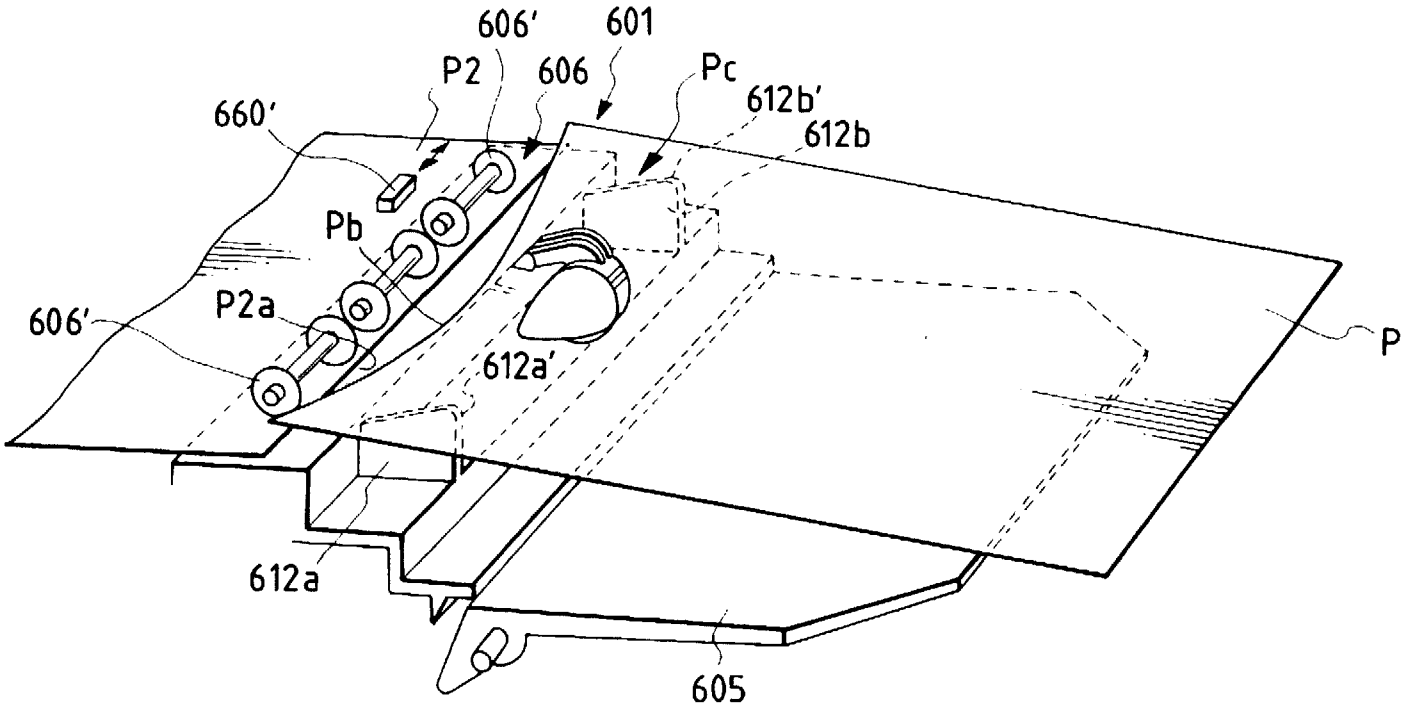
FIG. 6 PRIOR ART
Figure 7:
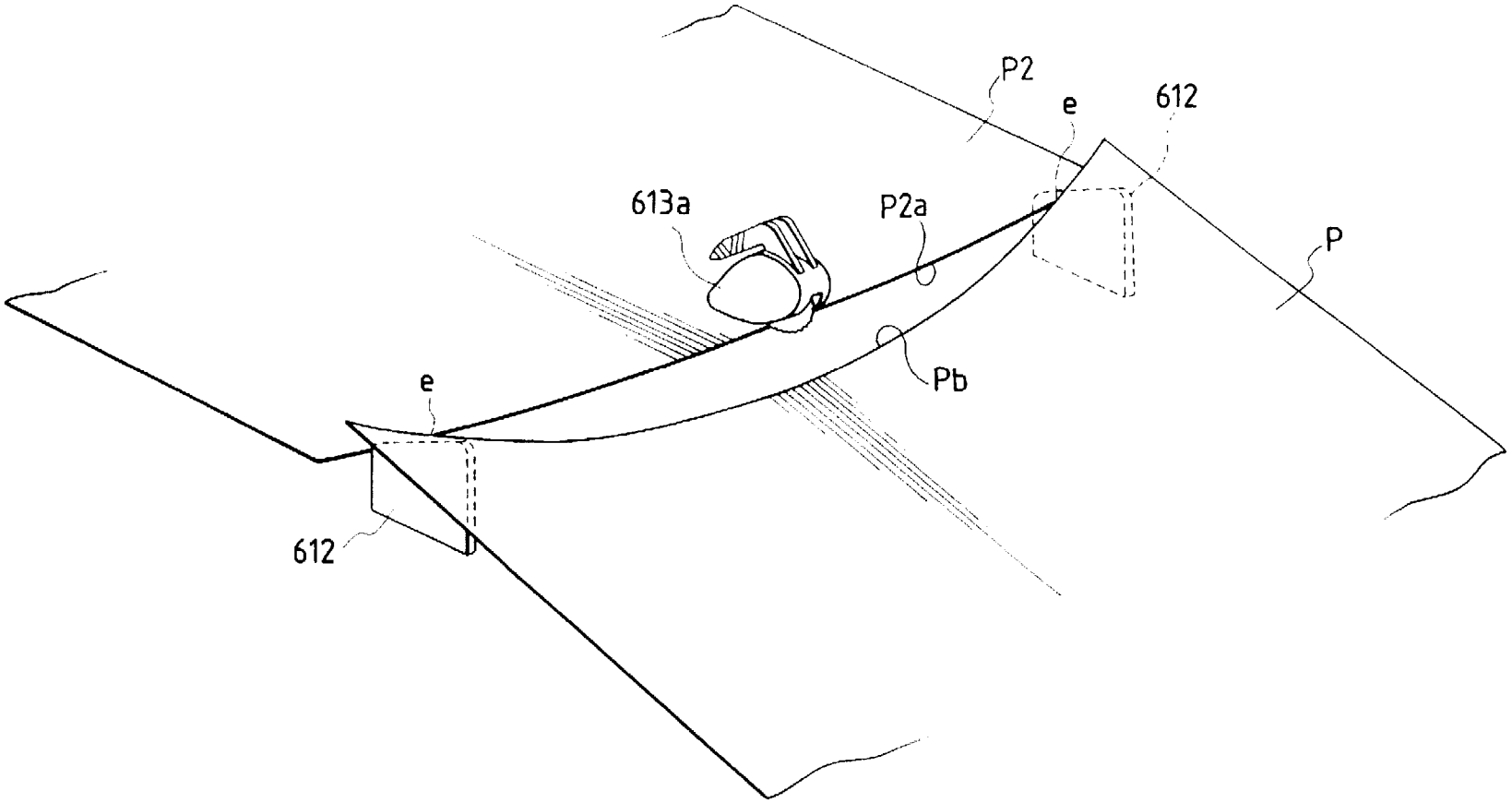
FIG. 7 PRIOR ART

Referring to FIG. 1*a*, an already-printed and discharged sheet, preceding sheet P1, has a trailing edge P1*b* supported by support portions 2 (see FIG. 6). Sheet feed roller 11 is driven in the direction of arrow A and sheet P2 is fed toward nipping region 25. As shown in FIG. 1*b*, sheet P2 is fed by driving roller 12 between driving roller 12 rotated in the direction of arrow B and pinch roller 13 rotated in the direction of arrow C, and data is printed on the front surface of sheet P2 by print head 14. As the printing operation proceeds, as shown in FIG. 1*c*, sheet P2 is continuously fed towards discharge section 1. When leading edge P2*a* of sheet P2 contacts trailing edge P1*b* of preceding sheet P1 (see FIG. 6), trailing edge P1*b* of preceding sheet P1 moves away from the support portions 2 in such a manner that preceding sheet P1 is urged out of sheet discharge section 1 by sheet P2. As a result, preceding sheet P1 drops off support portions 2, unless, of course, leading edge P2*a* of sheet P2 engages with trailing edge P1*b* of preceding sheet P1 (see the engaged portions "e" shown in FIG. 7). Sheet P1 drops onto a sheet discharge tray if the printer has a sheet discharge tray or onto, for example, the top of a desk on which the printer is placed, if the printer does not have a sheet discharge tray.

As described above, however, leading edge P2*a* of succeeding sheet P2 and trailing edge P1*b* of preceding sheet P1 may, in some cases, disadvantageously engage with each other (see the chained line in FIG. 1*c*). If, in such a case, succeeding sheet P2 is urged forward while attached to preceding sheet P1, sheet P1 is pushed out of the sheet discharge section by sheet P2, rather than dropping onto the sheet discharge tray or onto a preceding, already-printed sheet P1'.

Figure 1D:
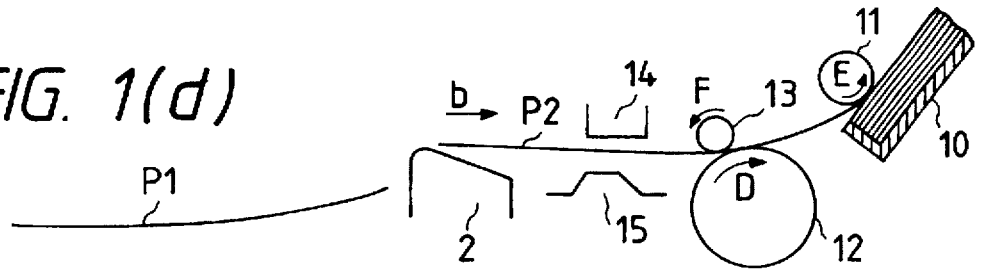

To overcome this problem, trailing edge P1*b* of the preceding sheet P1 shown by the chained line in FIG. 1*c* is disengaged from supporting portions 2 by contact with succeeding sheet P2, and sheet P2 is thereafter caused to be fed in the reverse direction as is indicated by Arrow "b" in FIG. 1*d* by reversing the rotation of driving roller 12 to rotate in the direction of arrow D. During this reversing motion, print head 14 does not print on sheet P2. In addition, sheet feed roller 11 may also be rotated in a reverse direction in the direction of arrow E or the driving of sheet feed roller 11 may be stopped so that sheet feed roller 11 can rotate as an idler wheel when it is driven by sheet P2 returning in the reverse feed direction, i.e. away from discharge section 1. As a result of this operation, trailing edge P1*b* of preceding sheet P1 is disengaged from leading edge P2*a* of succeeding sheet P2 without fail, preventing sheet P2 and sheet P1 from becoming attached one to the other. Therefore, the preceding, already-printed sheet P1 is reliably dropped off of supporting portions 2.

Figure 1E:
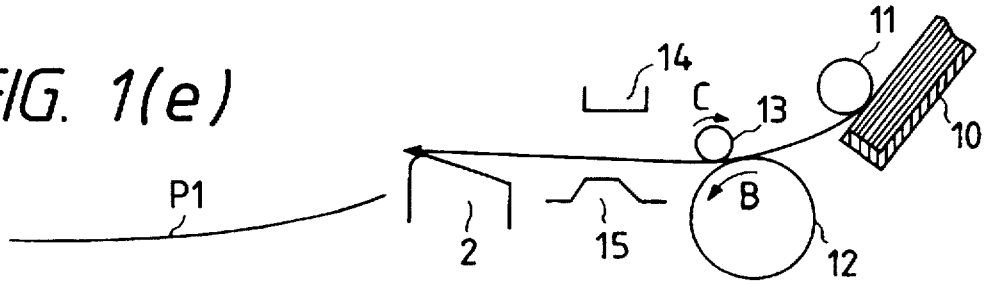

Next, as shown in FIG. 1*e*, sheet P2 is moved back to the position (shown in FIG. 1*c*) it had reached prior to having its direction reversed, and the printing operation is resumed. When the printing is complete, sheet P2 is discharged and placed under the same condition as sheet P1, as shown in FIG. 1*a*, and the operations depicted in FIGS. 1*a* through 1*e* are thereafter repeated.

Figure 2A:
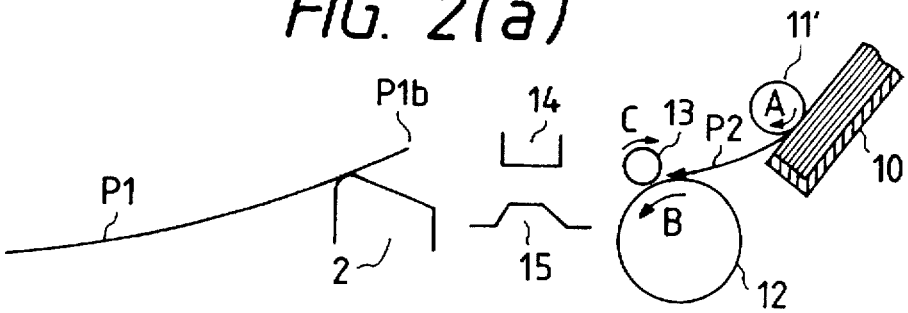
FIGS. 2*a* through 2*c* are schematic views showing the operation of a sheet discharge method for a printer in accordance with a second embodiment of the invention.
Figure 2B:
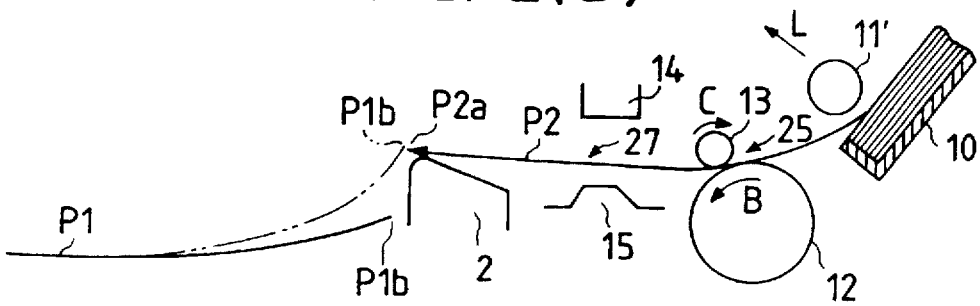
Figure 2C:
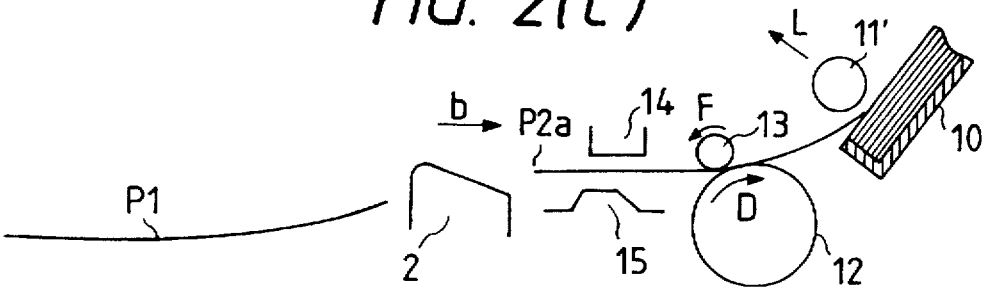

Reference is now made to FIGS. 2*a*–2*c* wherein a second embodiment of the invention is shown. Like numerals are utilized to reference like structuring, the primary difference between this embodiment and the first being that the printer includes a sheet feed roller 11' which is designed to contact sheet P2, as shown in FIG. 2*a*, and to be released from contact with sheet P2, as shown in FIGS. 2*b* and 2*c*.

In this embodiment, the printing operation is started following the contact between preceding sheet P1 and succeeding sheet P2. Thus, sheet P2 is fed in the discharge direction by driving roller 12 rotating in the direction of arrow B and pinch roller 13 in the direction of arrow C, and rotating feed roller 11 in the direction of arrow A as shown in FIG. 2*a*. Sheet P is fed until, as shown in FIG. 2*b*, leading edge P2*a* contacts trailing edge P1*b* of preceding sheet P1, thereby urging sheet P1 off of supporting portions 2. The feed direction of sheet P2 is thereafter reversed in the direction of arrow B, by reversing the direction of driving roller 12 to rotate in the direction of arrow D and F, as shown in FIG. 2*c*, to a position where print head 14 may begin to print. After driving roller 12 begins feeding sheet P2 in the discharge direction, sheet feed roller 11' is caused to move away from sheet P2 in the direction of arrow L.

As a result of this procedure, succeeding sheet P2 is caused to reverse direction after trailing edge P1*b* of preceding sheet P1 has been released from supporting portions 2. Therefore, the contact of trailing edge P1*b* of preceding sheet P1 with leading edge P2*a* of succeeding sheet P2 is disengaged without fail, thereby preventing sheet P2 and sheet P1 from becoming attached one to another, and allowing the already-printed sheet P1 to reliably drop off supporting portions 2.

In contrast to the first embodiment, which temporarily suspended the printing operation at the position shown in FIG. 1*c* so as to allow the direction of sheet P2 to be reversed, as shown in FIG. 1*d*, the second embodiment sheet discharge method causes preceding sheet P1 to be released from its supported position by contact with succeeding sheet P2 (FIG. 2*b*), prior to printing upon sheet P2. Thus, the positioning of sheet P2 for printing is easy compared to the method of the first embodiment where some printing had already been begun when the direction of sheet P2 was reversed, as sheet P2 must be positioned at the position where printing may begin again.

Further, as shown in FIG. 2*c*, the contact between sheet feed roller 11' and succeeding sheet P2 is released when the direction of sheet P2 is reversed, and therefore sheet feed roller 11' does not impede sheet P2, allowing sheet P2 to reverse directions smoothly.

Figure 3A:
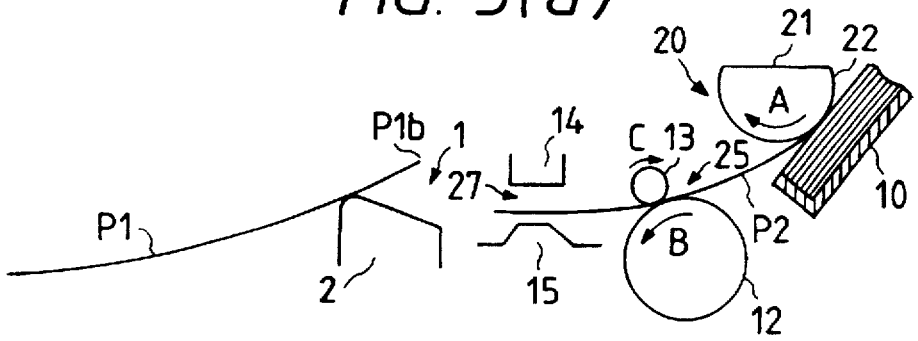
FIGS. 3*a* through 3*c* are schematic views showing the operation of a sheet discharge method for a printer in accordance with a third embodiment of the invention.
Figure 3B:
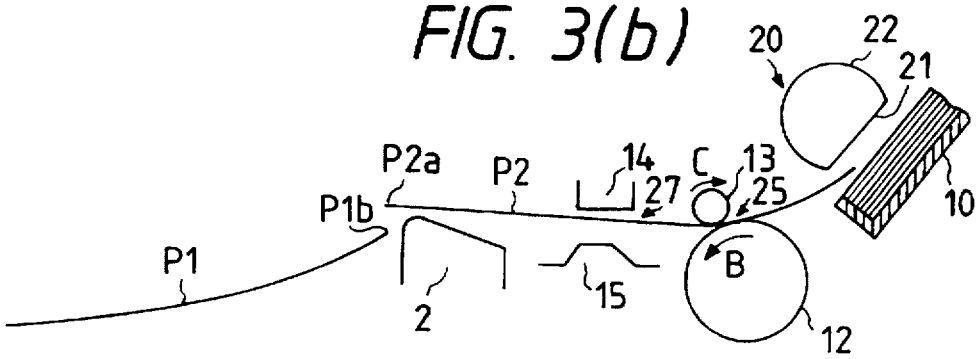
Figure 3C:
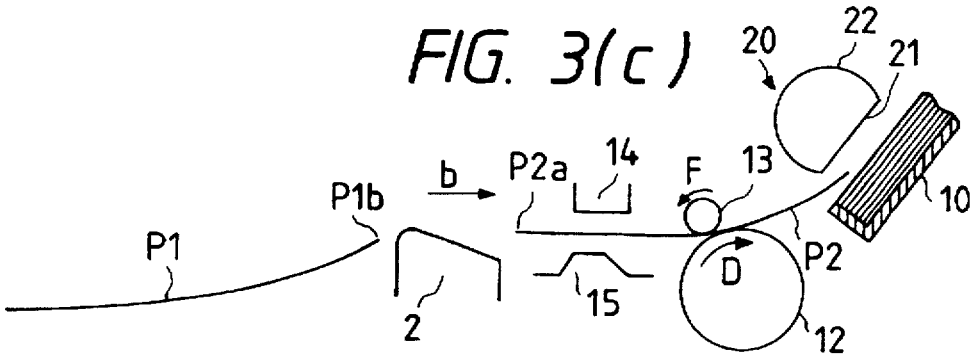

Reference is now made to FIGS. 3*a* to 3*c* wherein a third embodiment of the invention is provided. Like numbers are utilized to indicate like structures, the primary difference between this embodiment and the second embodiment being that the printer includes a sheet feed roller 20 that has a D-shaped cross section consisting of a straight face 21 and an arcuate face 22, which feeds sheet P2 to the nipping region 25 by bringing arcuate face 22 into contact with sheet P2. Thus, this embodiment differs from the second embodiment in that the cross section of sheet feed roller 20 is D-shaped rather than circular.

Sheet feed roller 20 is caused to make a full rotation in the direction of arrow A when sheet P2 is fed so that arcuate face 22 thereof is brought into contact with sheet P2 as shown in FIG. 3*a*. Again, driving roller 12 and pinch roller 13 rotate in the directions of arrows B and C, respectively. Sheet P2 is fed towards discharge section 1 so that leading edge P2*a* contacts trailing edge P1*b* of the preceding sheet P1, thereby causing preceding sheet P1 to drop off support portions 2 as shown in FIG. 3*b*. The feed direction of sheet P2 is thereafter reversed, in the direction of arrow b, by reversing the direction of driving roller 12 in the direction of arrow D, to a position where print head 14 may begin to print (FIG. 3*c*).

Thus, the succeeding sheet P2 is caused to reverse direction after trailing edge P1*b* of preceding sheet P1 has been released from supporting portions 2. Therefore, the contact between trailing edge P1*b* of preceding sheet P1 and leading edge P2*a* of succeeding sheet P2 is disengaged without fail, thereby preventing sheet P2 and P1 from becoming attached to each other, and allowing the already-printed sheet P1 to reliably drop off supporting portions 2.

In addition to the advantages gained by the second embodiment, this sheet discharge method automatically positions sheet feed roller 20 with the straight face 21 aligned with succeeding sheet P2 at the time the direction of sheet P2 is reversed. Therefore, succeeding sheet P2 does not contact sheet feed roller 20 when its direction is reversed and sheet feed roller 20 does not impede sheet P2. Thus, the third embodiment is more easily controlled as the operation of causing sheet feed roller 11' to move away from sheet P2 in the second embodiment is not required.

Thus, according to the present invention, by reversing the direction of the succeeding sheet after it contacts the preceding sheet, the preceding sheet can be reliably released from the supporting portions and dropped onto the sheet discharge tray.

The invention is not limited to the above embodiments. For example, the pair of support members need not necessarily take the same shape as each other or as described above.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A method for discharging at least two sheets from a printer, comprising the steps of:

feeding a first sheet, having a leading edge and a trailing edge, in a feed direction through a feed path and supporting the first sheet in the feed path with a support structure; feeding a second sheet, having a leading edge and a trailing edge, in the feed direction through the feed path and causing the leading edge of said second sheet to contact the trailing edge of said first sheet to urge said first sheet forward in the feed direction and then feeding said second sheet in a direction opposite from the feed direction, to cause the first sheet to become unsupported by the support structure and to be disengaged from the second sheet.

2. A method for discharging at least two sheets, comprising the steps of:

feeding a first sheet, having a leading edge and a trailing edge, from a sheet tray in a feed direction through a feed path to a first position and supporting said first sheet in the feed path with a support structure;

feeding a second sheet in the feed direction by rotating a driving roller in a rotating direction to a second position and causing a leading edge of said second sheet to contact a trailing edge of said first sheet to urge said first sheet forward in the feed direction and then feeding said second sheet in a direction opposite from the feed direction to a third position by rotating said driving roller in a direction opposite to the rotating direction to cause said first sheet to become unsupported by the support structure and to be disengaged from said second sheet.

3. The method of claim 2, comprising the steps of:

printing upon said second sheet as said second sheet is conveyed through a print region of the feed path prior to contacting said trailing edge of said first sheet; and after the second sheet is fed to the third position, feeding said second sheet in the feed direction to the second position by rotating said driving roller in the rotating direction.

4. The method of claim 2, wherein the feeding of said first sheet from said sheet tray in the feed direction is performed by rotating a sheet feed roller positioned to be in contact with said first sheet.

5. The method of claim 4, comprising the steps of:

feeding said second sheet from said sheet tray in the feed direction by bringing said sheet feed roller in contact with said second sheet disposed in said sheet tray and rotating said sheet feed roller; and disengaging said sheet feed roller from contact with a third sheet disposed in said sheet tray prior to feeding said second sheet to the third position.

6. The method of claim 5, wherein said sheet feed roller is disengaged from said third sheet by moving said sheet feed roller away from said second sheet tray.

7. The method of claim 6, comprising the step of after the second sheet is fed to the third position, feeding said second sheet in the feed direction to the second position by rotating said driving roller in the rotating direction.

8. The method of claim 4, wherein said sheet feed roller has a D-shaped cross section including a straight face and an arcuate face.

9. The method of claim 8, wherein said sheet feed roller feeds said second sheet from said sheet tray by contacting said second sheet with said arcuate face.

10. The method of claim 5, wherein said sheet feed roller has a D-shaped cross section including a straight face and an arcuate face, and wherein the step of disengaging said feed roller from said third sheet disposed in said sheet tray is performed by bringing said straight face of said sheet feed roller into a facing relationship with said sheet tray.

11. The method of claim 10, comprising the step of, after the second sheet is feed to the third position, feeding said second sheet in the feed direction to the second position.

12. The method of claim 10, wherein said sheet feed roller feeds said second sheet from said sheet tray by contacting said second sheet with said arcuate face.

* * * * *